US011183348B1

(12) United States Patent
Leccia et al.

(10) Patent No.: US 11,183,348 B1
(45) Date of Patent: Nov. 23, 2021

(54) VACUUM CIRCUIT INTERRUPTER WITH DECELERATOR WITH INTEGRATED LATCH ASSEMBLY

(71) Applicant: Eaton Intelligent Power Limited, Dublin (IE)

(72) Inventors: Brad Robert Leccia, Bethel Park, PA (US); Tyler Holp, Coraopolis, PA (US); Xin Zhou, Wexford, PA (US); Steven Zhenghong Chen, Coraopolis, PA (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/934,505

(22) Filed: Jul. 21, 2020

(51) Int. Cl.

| | |
|---|---|
| ***H01H 3/20*** | (2006.01) |
| ***H01H 3/22*** | (2006.01) |
| ***H01H 33/38*** | (2006.01) |
| ***H01H 33/666*** | (2006.01) |

(52) U.S. Cl.
CPC ..... *H01H 33/666* (2013.01); *H01H 3/20* (2013.01); *H01H 3/222* (2013.01); *H01H 33/38* (2013.01)

(58) Field of Classification Search
CPC ..... H01H 33/666; H01H 33/38; H01H 33/42; H01H 33/50; H01H 33/565; H01H 3/20; H01H 3/222; H01H 3/32; H01H 3/28
USPC ..... 218/140, 120, 141, 153, 154
See application file for complete search history.

(56) References Cited

U.S. PATENT DOCUMENTS 3,026,394 A 3/1962 Emmett
3,405,245 A 10/1968 Ito
3,534,304 A * 10/1970 Robinson ..... H01H 33/666 335/16
4,030,055 A * 6/1977 Kotos ..... H01H 1/54 335/195
4,107,496 A 8/1978 Clason
4,250,363 A 2/1981 Heberlein et al.
4,281,231 A 7/1981 Griesen et al.
6,580,345 B2 * 6/2003 Akita ..... H01H 33/285 218/141
6,930,271 B1 8/2005 Palmieri et al.
7,739,058 B2 6/2010 Maruyama
(Continued)

OTHER PUBLICATIONS

Bini, R. et al., "Interruption Technologies for HVDC Transmission: State-of-Art and Outlook", 2017 4th International Conference on Electric Power Equipment—Switching Technology—Xi'an—China, downloaded May 12, 2020.
(Continued)

*Primary Examiner* — William A Bolton
(74) *Attorney, Agent, or Firm* — Fox Rothschild LLP

(57) ABSTRACT

A circuit breaker includes a vacuum interrupter having a closed position and an open position. The circuit breaker includes a linkage operatively coupled to and extending from the vacuum interrupter and a high-speed actuator operatively connected to the linkage. The high-speed actuator is operable to move the linkage by a repulsion force and cause the vacuum interrupter to move to the open position. The circuit breaker includes a decelerator with an integrated latch assembly operatively coupled to the high-speed actuator. The decelerator decelerates the repulsion force of the high-speed actuator and latches the actuator with the integrated latch assembly to maintain the vacuum interrupter in the open position.

21 Claims, 10 Drawing Sheets

(56) References Cited

U.S. PATENT DOCUMENTS

| | | | | |
|---|---|---|---|---|
| 7,829,814 | B2 | 11/2010 | Marchand et al. | |
| 8,680,956 | B2 | 3/2014 | Kim et al. | |
| 8,912,871 | B2 * | 12/2014 | Lauraire | H01H 3/28 335/229 |
| 8,982,538 | B2 | 3/2015 | Leccia et al. | |
| 9,165,726 | B2 | 10/2015 | Dohnal et al. | |
| 9,183,996 | B2 | 11/2015 | Karlstrom et al. | |
| 9,196,439 | B2 | 11/2015 | Gentsch | |
| 9,396,896 | B2 | 7/2016 | Chen et al. | |
| 9,431,184 | B2 | 8/2016 | Lee et al. | |
| 9,478,383 | B2 * | 10/2016 | Lee | H01H 83/02 |
| 9,508,514 | B2 * | 11/2016 | Ohda | H01F 7/122 |
| 9,741,513 | B2 | 8/2017 | Schmitz et al. | |
| 9,842,713 | B2 | 12/2017 | Yu et al. | |
| 10,325,737 | B2 * | 6/2019 | Woo | H01H 33/28 |
| 10,580,599 | B1 | 3/2020 | Wang et al. | |
| 2012/0274428 | A1 | 11/2012 | Reuber et al. | |
| 2017/0154747 | A1 | 6/2017 | Bissal et al. | |
| 2017/0352507 | A1 | 12/2017 | Kim et al. | |
| 2020/0075274 | A1 * | 3/2020 | Park | H01H 33/565 |

OTHER PUBLICATIONS

Pei, X. et al., "Fast operating moving coil actuator for a vacuum", IEEE Transactions on Energy Conversion, 32(3), 931-940, 2017.

* cited by examiner

VACUUM CIRCUIT INTERRUPTER WITH DECELERATOR WITH INTEGRATED LATCH ASSEMBLY

BACKGROUND

Circuit breakers, sometimes referred to as circuit interrupters, include electrical contacts that connect to each other to pass current from a source to a load. The contacts may be separated in order to interrupt the delivery of current, either in response to a command or to protect electrical systems from electrical fault conditions such as current overloads, short circuits, and high or low voltage conditions.

In certain medium voltage circuit breakers, for example medium voltage hybrid circuit breakers, it is desirable to have a vacuum interrupter in which the contacts move with a fast opening speed. Some ultra-fast switching mechanisms can open the contacts in as few as 500 microseconds, with speeds of travel approaching 4 m/s. In conditions that approach short circuit conditions, the circuit breaker must achieve a sufficiently large contact gap (typically 1.5 mm or 2 mm) in this short time frame. Traditional motor-driven and linear actuators cannot achieve such opening speeds.

To address this, some have proposed using a Thomson coil as the actuator. However, Thomson coils cannot hold the circuit breaker open after interruption without remaining energized.

This document describes methods and systems that are intended to address some or all of the problems described above.

SUMMARY

In various embodiments, a circuit breaker includes a vacuum interrupter having a closed position and an open position. The circuit breaker includes a linkage operatively coupled to and extending from the vacuum interrupter and a high-speed actuator operatively connected to the linkage. The high-speed actuator is operable to move the linkage by a repulsion force and cause the vacuum interrupter to move to the open position. The circuit breaker includes a decelerator with an integrated latch assembly operatively coupled to the high-speed actuator. The decelerator is operative to decelerate the repulsion force of the high-speed actuator and latch the actuator with the integrated latch assembly to maintain the vacuum interrupter in the open position.

In some embodiments, the high-speed actuator may include a Thomson coil actuator.

In some embodiments, the decelerator with integrated latch assembly is configured to latch at a point of zero velocity or nearly zero velocity.

In some embodiments, the decelerator with the integrated latch assembly includes a non-conductive adapter with a latching groove. The non-conductive adapter is operatively connected to the linkage so that as the repulsion plate is repelled. The non-conductive adapter is pushed, decelerated by the decelerator to a near zero velocity and automatically latched.

In some embodiments, the decelerator may include a coil spring that is positioned to apply a frictional force to the non-conductive adapter.

In some embodiments, the adapter may include a cam and the latching groove. The cam is positioned to compress the coil spring and decelerate motion of the non-conductive adapter as the linkage is moved by the repulsion force until the latching groove reaches and latches the coil spring.

In some embodiments, the high-speed actuator may include a repulsion plate that is connected to the adapter and operable to be repelled by a repulsion force.

In some embodiments, the decelerator may include a shock absorber, configured to generate a supplemental deceleration force exerted on the adapter and absorb at least a portion of the repulsion force in response to being pushed by the repulsion plate.

In some embodiments, the high-speed actuator is a first high-speed actuator. The decelerator may include a second high-speed actuator that is configured to provide a deceleration force.

In some embodiments, the first high-speed actuator comprises a first Thomson coil actuator and the second high-speed actuator comprises a second Thomson coil actuator. The circuit breaker may include a driver electrically connected to the first high-speed actuator and the second high-speed actuator. The driver is configured to energize the first Thomson coil actuator to repel the repulsion plate to open the vacuum interrupter.

In some embodiments, a vacuum interrupter includes a fixed electrode that leads to a fixed contact, and a moveable electrode that leads to a moveable contact. The vacuum interrupter includes a linkage operatively coupled to the moveable electrode and that extends from the vacuum interrupter and a high-speed actuator operatively connected to the linkage. The high-speed actuator is operable to move the linkage by a repulsion force to move the linkage, which pulls the moveable contact away from the fixed contact to open the vacuum interrupter. The vacuum interrupter includes a decelerator with an integrated latch assembly operatively coupled to the high-speed actuator and the linkage. The decelerator is operative to decelerate the repulsion force of the high-speed actuator and latch the linkage with the integrated latch assembly to maintain the vacuum interrupter in an open position with the moveable electrode separated from the fixed electrode.

In some embodiments, the decelerator with the integrated latch assembly comprises a non-conductive adapter with a latching groove. The non-conductive adapter operatively connected to the linkage.

In some embodiments, the high-speed actuator further comprises a repulsion plate configured to be repelled by a repulsion force that is greater than atmospheric force.

In some embodiments, the non-conductive adapter further comprises a cam. The cam is positioned to compress the coil spring and decelerate motion of the non-conductive adapter as the linkage moves to the open position. The coil spring automatically decompresses into the latching groove to latch the linkage in the open position.

DETAILED DESCRIPTION

As used in this document, the singular forms "a," "an," and "the" include plural references unless the context clearly dictates otherwise. Unless defined otherwise, all technical and scientific terms used in this document have the same meanings as commonly understood by one of ordinary skill in the art. As used in this document, the term "comprising" (or "comprises") means "including (or includes), but not limited to." When used in this document, the term "exemplary" is intended to mean "by way of example" and is not intended to indicate that a particular exemplary item is preferred or required.

In this document, when terms such "first" and "second" are used to modify a noun, such use is simply intended to distinguish one item from another, and is not intended to require a sequential order unless specifically stated. The term "approximately," when used in connection with a numeric value, is intended to include values that are close to, but not exactly, the number. For example, in some embodiments, the term "approximately" may include values that are within +/−10 percent of the value.

When used in this document, terms such as "top" and "bottom," "upper" and "lower", or "front" and "rear," are not intended to have absolute orientations but are instead intended to describe relative positions of various components with respect to each other. For example, a first component may be an "upper" component and a second component may be a "lower" component when a device of which the components are a part is oriented in a direction in which those components are so oriented with respect to each other. The relative orientations of the components may be reversed, or the components may be on the same plane, if the orientation of the structure that contains the components is changed. The claims are intended to include all orientations of a device containing such components.

"Medium voltage" (MV) systems include electrical systems that are rated to handle voltages from about 600 V to about 100 kV. Some standards define MV as including the voltage range of 600 V to about 69 kV. (See NECA/NEMA 600-2003). Other standards include ranges that have a lower end of 1 kV, 1.5 kV or 2.4 kV and an upper end of 35 kV, 38 kV, 65 kV or 69 kV. (See, for example, IEC 60038, ANSI/IEEE 1585-200 and IEEE Std. 1623-2004, which define MV as 1 kV-35 kV.) Except where stated otherwise, in this document the term "medium voltage" is intended to include the voltage range from approximately 1 kV to approximately 100 kV, as well as all possible sub-ranges within that range, such as approximately 1 kV to approximately 38 kV.

Figure 1:
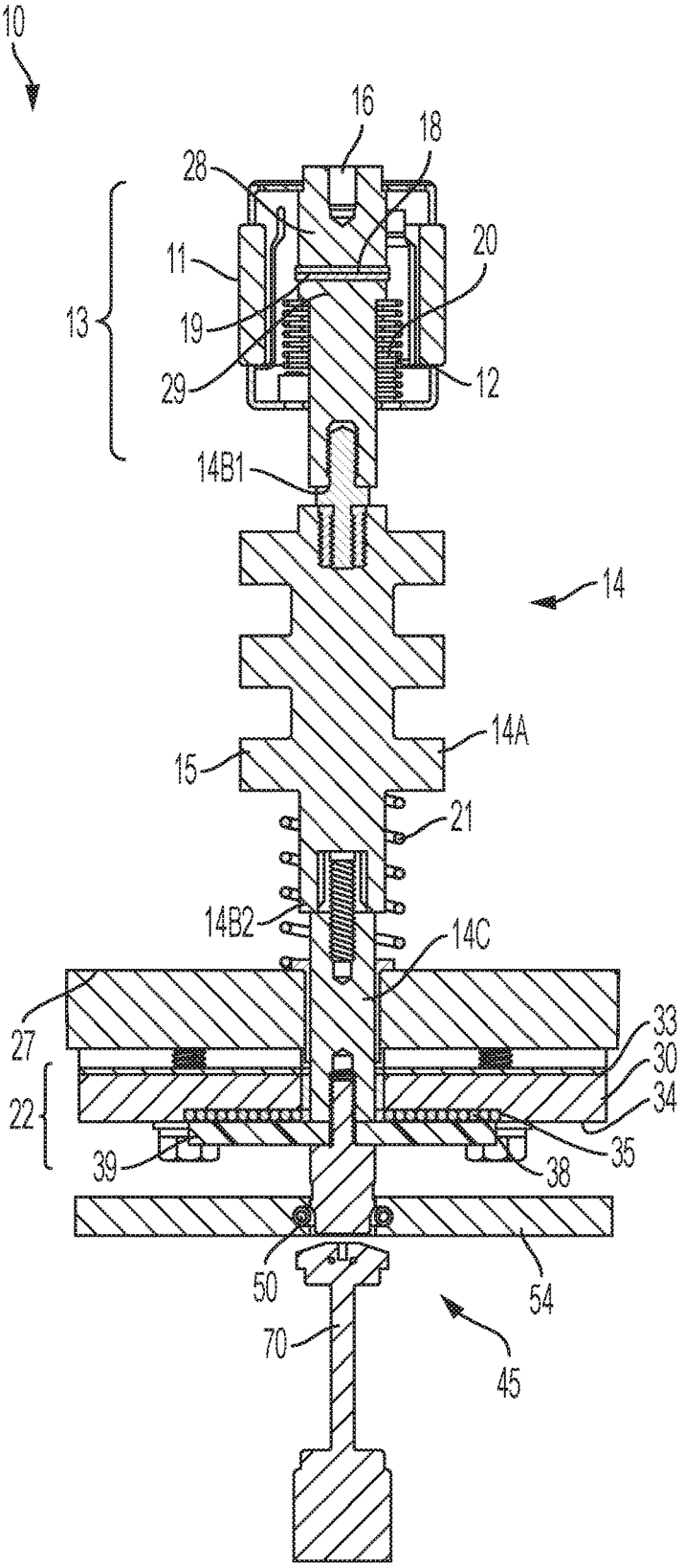
FIG. 1 illustrates a cross-sectional view of a circuit breaker having a decelerator with integrated latch assembly and with certain internal components shown.

Referring to FIG. 1, a cross-sectional view of a circuit breaker 10 with certain internal components shown. The circuit breaker 10 may be a vacuum interrupter switch in accordance with an aspect of the disclosure. The terms circuit breaker and vacuum interrupter switch may be used interchangeably herein. In some embodiments, the circuit breaker 10 may be employed in a direct current (DC) system to interrupt DC power. In other embodiments, the circuit breaker 10 may be employed in an alternating current (AC) circuit, for example as a single pole of a three-pole AC circuit breaker.

The circuit breaker 10 (which may include a vacuum interrupter switch that is a component of circuit breaker 10) may include a pole unit (not shown) that contains a vacuum interrupter 13. Referring to the cross-sectional views of FIG. 1, the vacuum interrupter 13 includes a housing 11 that contains a sealed vacuum chamber that holds a moving electrode 29 that leads to a moving contact 19, and a fixed electrode 28 that leads to a fixed contact 18. The moving electrode 29 and moving contact 19 are electrically connected to a first terminal (not shown), and the fixed electrode 28 and fixed contact 18 are electrically connected to a second terminal 16. The terminals (only terminal 16 shown) extend from the housing 11 such that one of the terminals (only terminal 16 shown) may be electrically connected to a power source and the other terminal may be electrically connected to a load, thus positioning the vacuum interrupter 13 to interrupt the delivery of power to the load when the contacts are separated.

With continued reference to FIG. 1, a linkage 14 may be provided. The linkage 14 may include one or more structures formed of a non-conductive (insulating) material which extends from the moving electrode 29 to and beyond an end of the housing 11 that is proximate to the contact 19. The cross section view of FIG. 1 illustrates that the linkage 14 may include a length of insulator section 14A. One (first) end of the insulator section 14A may include a first interconnecting component 14B1 that extends in the direction of the housing 11. For example, the first interconnecting component 14B1 connects to a free end of moving electrode 29 extending out of housing 11. Another (second) end of the insulator section 14A may include a second interconnecting component 14B2 which connects to a drive shaft 14C of the linkage 14.

The linkage 14 may include one or more components 14B1 and 14B2 that are included within the pole unit, and any variation of intermediate interconnecting components that operate so that when the drive shaft 14C is pulled or pushed, the interconnecting components 14B1 and 14B2 and insulator section 14A will be moved by a corresponding force and in unison. For example, an end of the drive shaft 14C may connect to a high-speed actuator 22.

The breaker 10 may also include a contact force applicator 21, such as a compression spring. The insulator section 14A include at least one sub-section of a particular diameter, and it may include at least one sub-section 15 having a relatively larger diameter. The contact force applicator 21 and the high-speed actuator 22 may be mechanically positioned in series. The drive shaft 14C of the linkage 14 extends from the contact force applicator 21 to the high-speed actuator 22. Specifically, between the contact force applicator 21 and the high-speed actuator 22 a planar support plate 27 of the breaker 10 is provided, the planar support plate 27 which can be fixedly mounted as will be discussed in relation to FIGS. 6A-6C.

In operation, the contact force applicator 21 is compressed against the planar support plate 27 as a force is applied from the one sub-section 15, when the vacuum interrupter 13 is forced open. The drive shaft 14C of the linkage 14 extends through the planar support plate 27 and couples to the high-speed actuator 22. The planar support plate 27 may be part of a mounting sub-system such as a mounting bracket, as will be described in more detail in relation to FIGS. 6A-6C. The planar support plate 27 may include a hole for journaling a portion of drive shaft 14C therethrough. The hole may include a center axis configured to align with a longitudinal axis of the linkage 14.

The high-speed actuator 22 further comprises an actuator mount 30. The actuator mount 30 may include a hole having a center axis aligned with the hole of the planar support plate 27. The hole of the actuator mount 30 for journaling a portion of drive shaft 14C therethrough. The hole of the actuator mount 30 has a center axis configured to align with a longitudinal axis of the linkage 14. The actuator mount 30 may include a first (top) side 33 and a second (bottom) side 34 opposite the first side 33. The second side 34 may include a recess cavity 35. The high-speed actuator 22 may include a Thomson coil 38.

The Thomson coil 38 may be recessed in the recess cavity 35. The high-speed actuator 22 may include a repulsion plate 39 (i.e., Thomson coil plate) which may be a conductive plate. The holes through the actuator mount 30 and the planar support plate 27 are larger than a diameter of the drive shaft 14C of the linkage 14 so that segment 14C may be pushed and pulled therethrough unobstructed.

Figure 2:
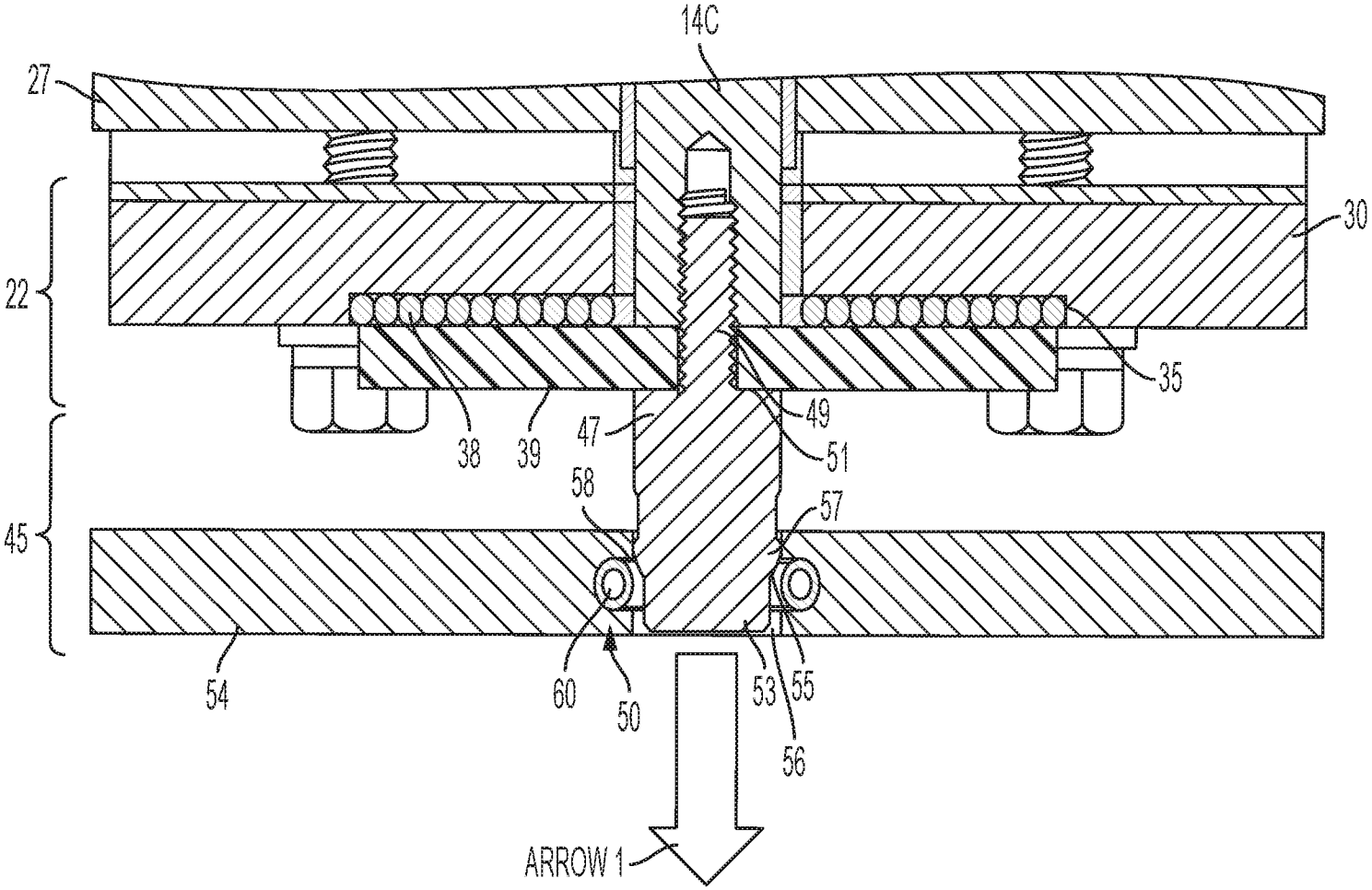
FIG. 2 illustrates a cross-sectional view of components of a Thomson coil that may be used as a high-speed actuator and components of the decelerator with an integrated latch assembly.
Figure 3:
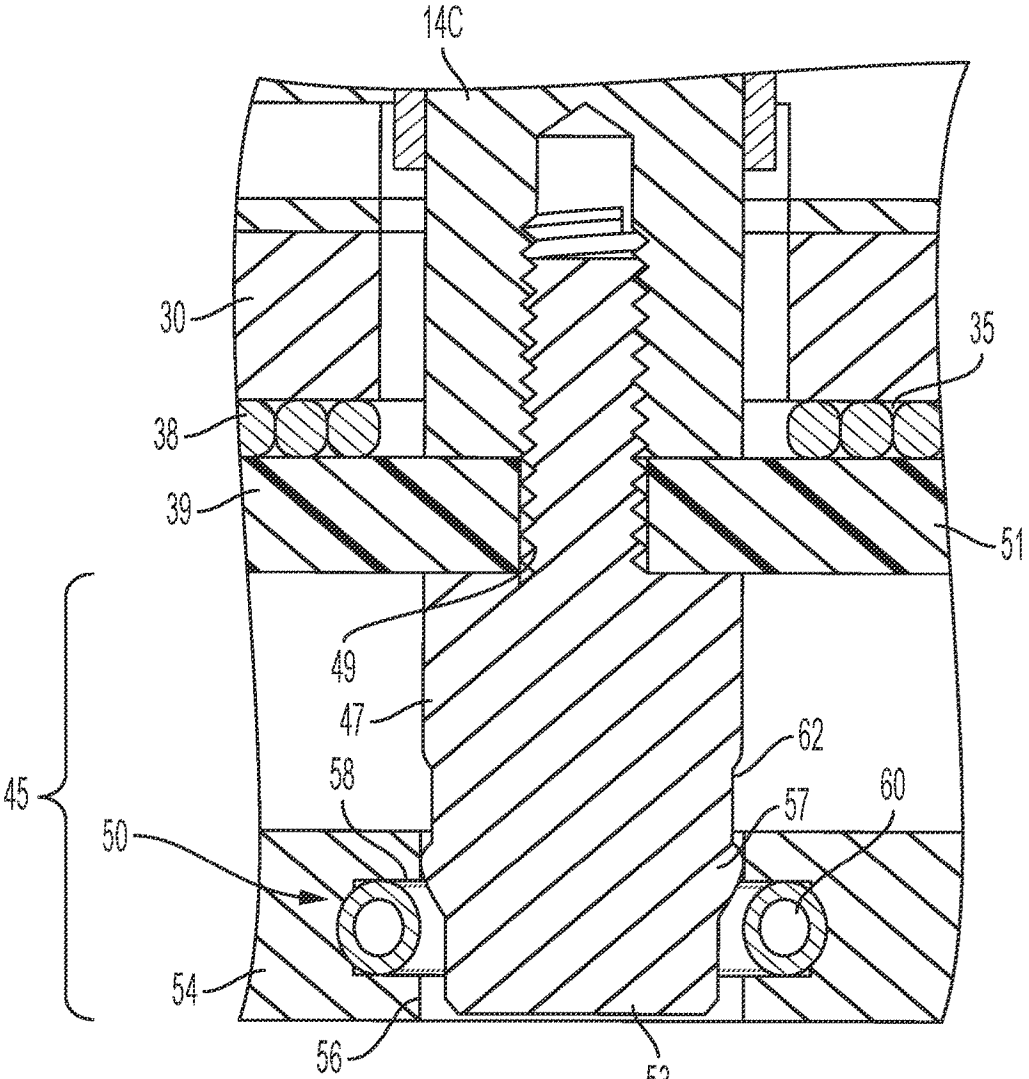
FIG. 3 illustrates a partial view of the cross-sectional view of FIG. 2.

With reference also to FIGS. 2-3, cross-sectional views of components of a Thomson coil that may be used as a high-speed actuator and components of a decelerator with an integrated latch assembly 50 are illustrated. FIG. 3 illustrates a partial view of the cross-sectional view of FIG. 2. Example high-speed actuators 22 that can achieve high opening speeds include a Thomson coil actuator or a piezo-electric actuator. FIG. 2 illustrates an example Thomson coil actuator 22 that includes a Thomson coil 38 and a repulsion plate 39 which serve as an armature. The Thomson coil 38 is a relatively flat spiral coil that is wound in either a clockwise or counterclockwise direction around the non-conductive linkage 14 and specifically, around drive shaft 14C.

Figure 6A:
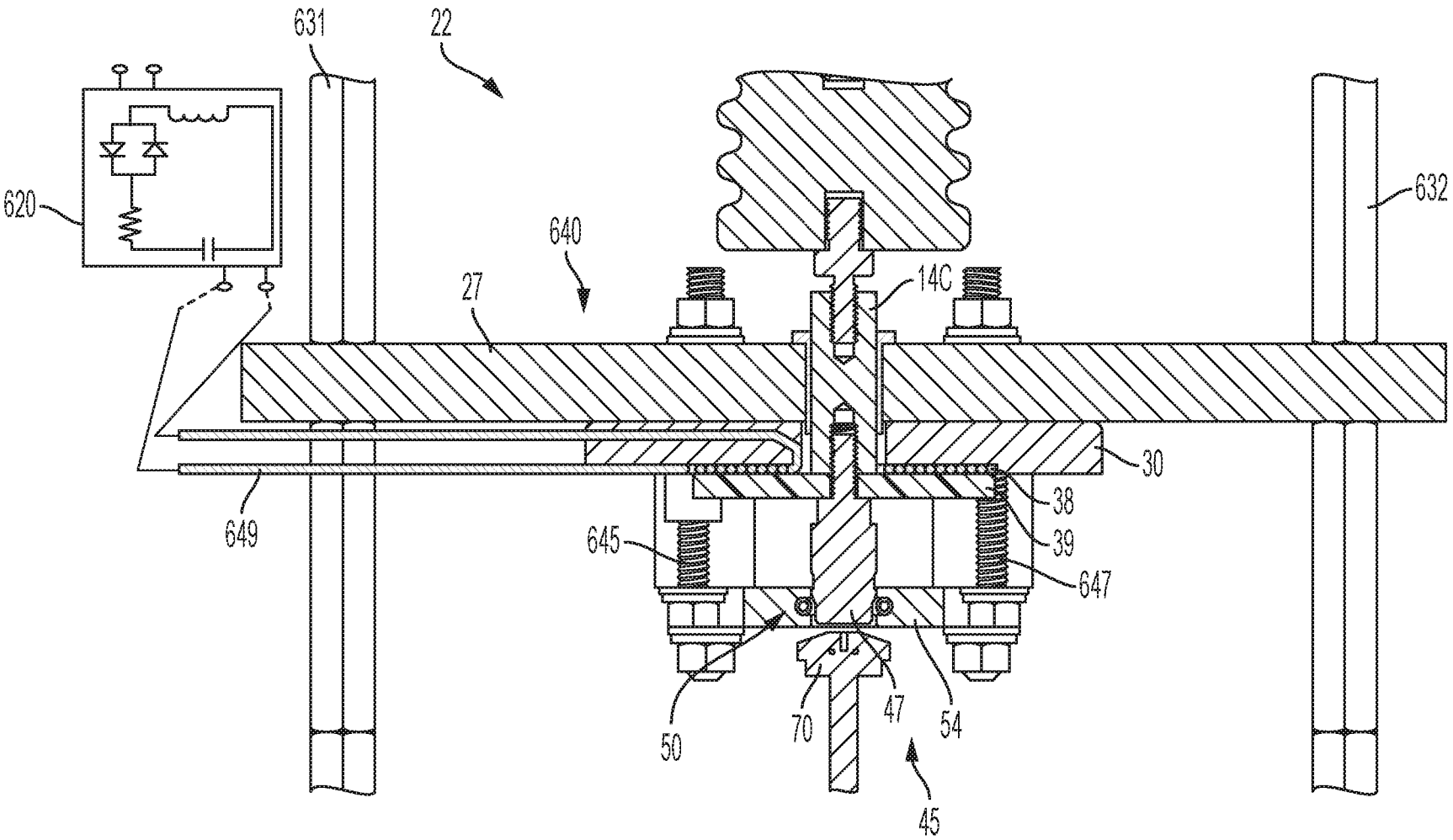
FIG. 6A illustrates a cross-sectional view of the high speed actuator in a closed position and components of the decelerator.

The repulsion plate 39 may be in the form of a disc or other structure that is connected directly or indirectly to the linkage 14 to serve as an armature that may drive the linkage 14 in one direction or the other. The linkage 14 passes through the center of the Thomson coil 38 that receives the drive shaft 14C of the linkage 14. The linkage 14 also may pass through the contact force applicator 21. The Thomson coil 38 is electrically connected to a driver 620 (FIG. 6A).

The driver 620 (FIG. 6A) may selectively energize the Thomson coil 38. When the driver 620 energizes the Thomson coil 38, the Thomson coil 38 will generate a magnetic force that will repel the repulsion plate 39 away from the Thomson coil 38. This causes the linkage 14 to move in a downward direction in the orientation denoted by ARROW 1 in FIG. 2, which moves the moveable electrode 29 away from the fixed electrode 28 in the vacuum interrupter 13 and opens the circuit (i.e., circuit breaker 10).

FIG. 1 illustrates the circuit breaker 10 in a closed position. In this position, the fixed contact 18 and moving contact 19 are in contact, providing a conductive path between the terminals (only terminal 16 shown). When the circuit breaker 10 is closed, the contact force applicator 21 is in a non-compressed state or less compressed state as compared to when the breaker 10 is open.

In operation, one or more drivers (such as driver 620 in FIG. 6A) may cause the Thomson coil (or other high-speed actuator 22) to first actuate, energize and pull the linkage 14 away from fixed contact 18 in housing 11, separating the contacts 18, 19 in the vacuum interrupter 13. However, the path of travel of the linkage 14 will be restricted when the high-speed actuator 22 has pulled the linkage 14 to the end of the path of travel of the repulsion plate 39 and/or decelerated, as will be described in more detail in relation to FIGS. 6A-6C.

Referring still to FIGS. 1-3, the circuit breaker 10 may include a decelerator 45 with an integrated latch assembly 50 wherein the decelerator 45 with the integrated latch assembly 50 are operatively coupled to the linkage 14. The decelerator 45 includes an adapter 47 having a fastening end 49. The adapter 47 is a member that extends from the linkage, and which optionally may be an end portion of the linkage. The fastening end 49 may include a seat 51 which may engage an underside of the repulsion plate 39. The fastening end 49 may include a male element which passes through a hole in the repulsion plate 39 and secures within an end of the drive shaft 14C of the linkage 14, by way of non-limiting example. Alternately, the fastening end 49 may be a female element, while the drive shaft 14C may include a male fastening element. Nonetheless, other fastening configurations may be used.

The decelerator 45 may include a fixed latching plate 54 configured to interface with a latching end 53 of adapter 47. The fixed latching plate 54 includes a slide channel 56 to review the adapter 47 in the latching plate 54. The fixed latching plate 54 includes a recessed annulus cavity 58 configured to support therein a resilient latching and decelerator force member 60. The latching end 53 comprises a cam 57 with a ramp profile configured to engage the resilient latching and decelerator force member 60, as will be described in relation to FIG. 5.

The decelerator 45 may include a shock absorber 70 (FIG. 1), in some scenarios. The shock absorber 70 may be positioned in-line with the adapter 47. The shock absorber 70 may be positioned in-line with and below a distal end of the latching end 53.

Figure 4:
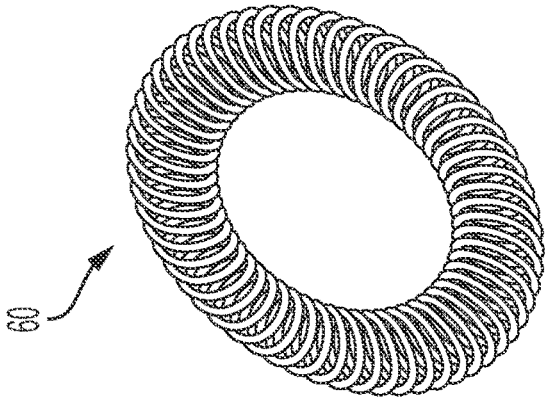
FIG. 4 illustrates a canted coil spring.

The resilient latching and deceleration force member 60 comprises a coil spring (FIG. 4). The coil spring 60 may include a canted spring profile wherein in conjunction with an inclined profile and groove 62 (FIG. 5) embedded in the latching end 53 of adapter 47, the decelerator 45 automatically decelerates the mass of at least the linkage 14 and repulsion plate 39 and latch a vacuum interrupter 13 into an open position. In operation, the opening of the vacuum interrupter 12 is in reciprocity to the forces of the high-speed actuator 22. The incline profile of the canted coil spring (i.e., resilient latching and deceleration force member 60) is used to compress the canted coil spring, increasing compression and frictional forces being applied to the latching end 53 and decelerating the moving mass of at least the linkage 14 and repulsion plate 39 with assistance from a shock absorber 70. The shock absorber 70 may include a hard rubber head with steel shaft, to receive and absorb impact.

In operation, once the vacuum interrupter 13 is open, the decelerator 45 is configured to decelerate the force opening of the vacuum interrupter 13 with compression forces from the coil spring that once released at the end of a deceleration phase such compression forces expands the coil spring into a groove to latch the linkage 14 and the vacuum interrupter 13 to the open position. The atmospheric force within the vacuum interrupter 13 provides a force tending to pull the vacuum interrupter 13 close. The closed state of the vacuum interrupter 13 is shown in FIG. 1 wherein in a sealed vacuum chamber a force holds together a moving electrode 29 that leads to a moving contact 19 and a fixed electrode 28 that leads to a fixed contact 18.

The high-speed actuator 22 may provide a force greater than the combined force by the atmospheric pressure and the contact force applicator to open the vacuum interrupter 13 wherein, the actuator 22 includes a repulsion plate 39 configured to be repelled by the magnetic force selectively generated by the Thomson coil 38. As the repulsion plate 39 is repelled, a force greater than the combined force by the atmospheric force and the contact force applicator which closes the vacuum interrupter 13 causes the vacuum interrupter 13 to open such that the moving electrode 29 that leads to a moving contact 19 is forced away from the fixed electrode 28 that leads to the fixed contact 18.

The repulsion plate 39 causes a force to be applied to the adapter 47 such that the repulsion plate 39 pushes the latching end 53 to a latch position. The repulsion plate 39 provides a latching plunger which moves the latching end 53 down, which in turn compresses the coil spring 60 to effectuate deceleration of the mass of at least the linkage 14 and repulsion plate 39. Furthermore, as the coil spring moves into the latching groove 62, the compression releases so that the coil spring automatically expands and latches in the latching groove 62 of the latching end 53.

The groove 62 may be positioned near the point of zero velocity to allow the canted coil spring to latch in place. In a scenario, the canted coil spring latches in groove 62 at almost zero motion of the mass of at least the linkage 14 and repulsion plate 39. The latching force may be sufficient to hold the vacuum interrupter 13 open until another mechanism (not described) is used to close the vacuum interrupter 13.

The repulsion plate 39 may be configured to be return to an initial position which is essentially next to the Thomson coil 38 which allows the latch assembly 50 to unlatch and the vacuum interrupter 13 to close. The coil spring 60 may be de-latched from groove 62. For example, a force would be applied to the adapter 47 so that the cam 57 would be push upward and the spring 60 de-latched. While the spring 60 is in groove 62, the spring may provide balancing, compression, and friction on the adapter 47 to oppose any atmospheric pressure in the vacuum interrupter 13 and maintain the latched state of the latch assembly 50.

In a scenario, shock absorber 70 may be part of the decelerator 45. The shock absorber 70 may be used for absorbing impact forces exerted by the adapter 47 and provide a tuned deceleration force. The shock absorber 70 may be positioned in-line with the adapter 47 to provide a supplemental deceleration force to the deceleration force generated by the coil spring. The supplemental deceleration force and the deceleration force together work to achieve zero motion of the mass to coincide with moment the latching groove 62 of the adapter 47 becomes generally aligned with the coil spring 60. The shock absorber 70 can be adjusted to tune the supplemental deceleration force to achieve zero motion of the mass of at least the linkage 14 and repulsion plate 39.

Figure 5:
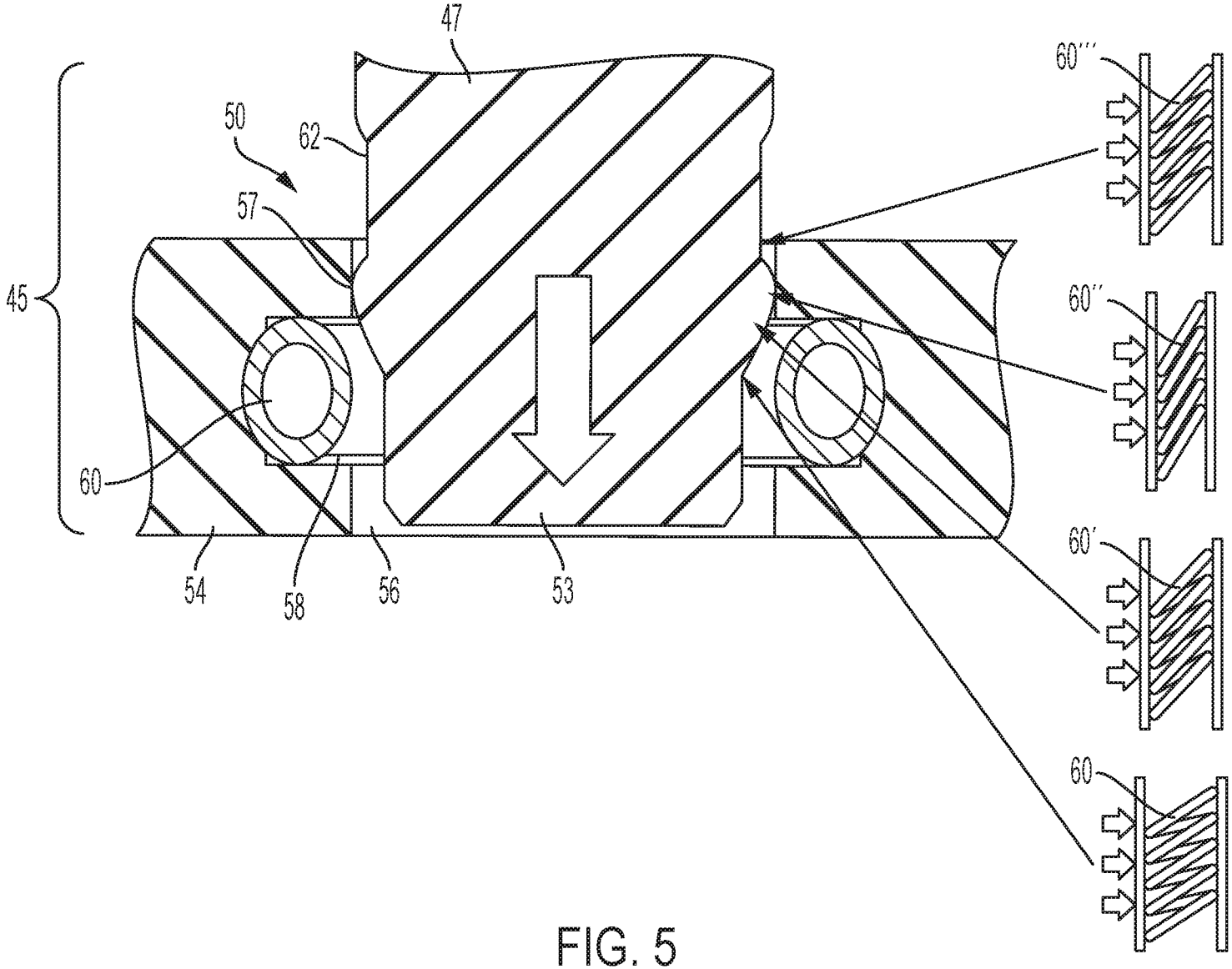
FIG. 5 illustrates a partial view of the components of the decelerator relative to inclination profiles of the canted coil spring.

FIG. 5 illustrates a partial view of the components of the decelerator relative to inclination profiles of the canted coil spring. The coil spring 60 has a canted spring profile with a first friction force being exerted on the adapter 47. The spring 60 may be compressed by a first amount. The profile of spring 60 is before the spring 60 becomes compressed by the cam 57. In other words, the repulsion plate 39 is in its initial position, as shown in FIG. 1, such that the vacuum interrupter 13 is closed.

Referring also to FIG. 1, the high-speed actuator 22 comprises a repulsion plate 39 repelled by a repulsion force, the repulsion force being greater than the atmospheric force. The decelerator 45 with the integrated latch assembly 50 comprises a non-conductive adapter 47 with a latching groove 62, the non-conductive adapter operatively connected to the linkage 14 and the repulsion plate 39 so that as the repulsion plate 39 is repelled, the non-conductive adapter 47 being pushed, decelerated by the decelerator to a near zero velocity and automatically latched.

As shown in FIG. 5, the non-conductive adapter 47 comprises a cam 57 with a ramp (cam) profile to a latching groove 62, the cam 57 compresses the canted coil spring to increase the frictional force along the ramp (cam) profile to decelerate motion of the non-conductive adapter 47. The spring's starting position (spring 60) shows that the spring's coils are angled in a direction that points downward to the end of the adapter 47. As the adapter 47 moves down and the cam 57 compresses the spring, spring 60' represents a spring profile as the result of a second friction force generated by increased compression forces exerted on the spring 60 by a portion of the cam surface of cam 57. The spring 60" represents a spring profile as the result of a third friction force generated by still further increased compression forces exerted on the spring 60 by another portion of the cam surface of cam 57 as the adapter continues to move downward.

The spring 60''' represents spring profile as the result of a fourth friction force generated by a release of at least a portion of the compression force exerted on the spring 60 as the spring moves into the latching groove 62. In position 60", the spring 60 reached the end of the cam profile and enters the latching groove 62. In a scenario, the decelerator 45 reaches near zero velocity as the latching groove 62 and spring 60 align. The decelerator 45 is configured to effectuate deceleration of a moving mass of at least the linkage 14 and repulsion plate 39, wherein the coil spring 60 automatically decompresses into the latching groove 62 to latch the linkage 14 and the vacuum interrupter 13 open. Tuning of the deceleration forces may be accomplished by the cam profile, and the recessed annulus cavity 58. The shallower the cavity 58 housing the spring 60 may increase the amount of frictional forces created by spring 60 on the adapter 47.

FIG. 6A illustrates a cross-sectional view of the high speed actuator 22 in a closed position and components of the decelerator 45. The circuit breaker or a vacuum interrupter switch 10 (FIG. 1) includes mounting brackets 631, 632 or other mounting structures at each end so that the distance between the mounting brackets 631, 32 or other ending structures remains fixed when the breaker or a vacuum interrupter switch 10 is open or closed. The mounting brackets 631, 632 are coupled the planar support plate 27 which may be part of a mounting sub-system. The planar support plate 27 has coupled thereto a support structure 640 comprising the planar support plate 27 and first and second fasteners 645 and 647 coupled to and through the planar support plate 27. The first and second fasteners 645 and 647 may be connected to the fixed latching plate 54 and the actuator mount 30.

The actuator mount 30 may include channels for conductors 649 coupled to the Thompson coil 38 and to driver 620. The conductors 649 may be coupled to the driver 620 to energize the coil 38. The repulsion plate 39 is shown in a first position. The first position corresponds generally to a closed state of the vacuum interrupter 13 and an unlatched state of the latch assembly 50 (FIGS. 3 and 5). In FIG. 6A, the Thompson coil 38 is not energized by the driver 620. Accordingly, the repulsion plate 39 is not being repelled.

The decelerator 45 has an integrated latch assembly 50 operatively couple to the high-speed actuator 22 and the linkage 14, the decelerator 45 operative to decelerate the repulsion force of the high-speed actuator 22 and latch with the integrated latch assembly 50 the linkage 14 via the drive shaft 14C to maintain the open vacuum interrupter in an open position. The adapter 47 is shown in a first position corresponding to an unlatched position.

Figure 6B:
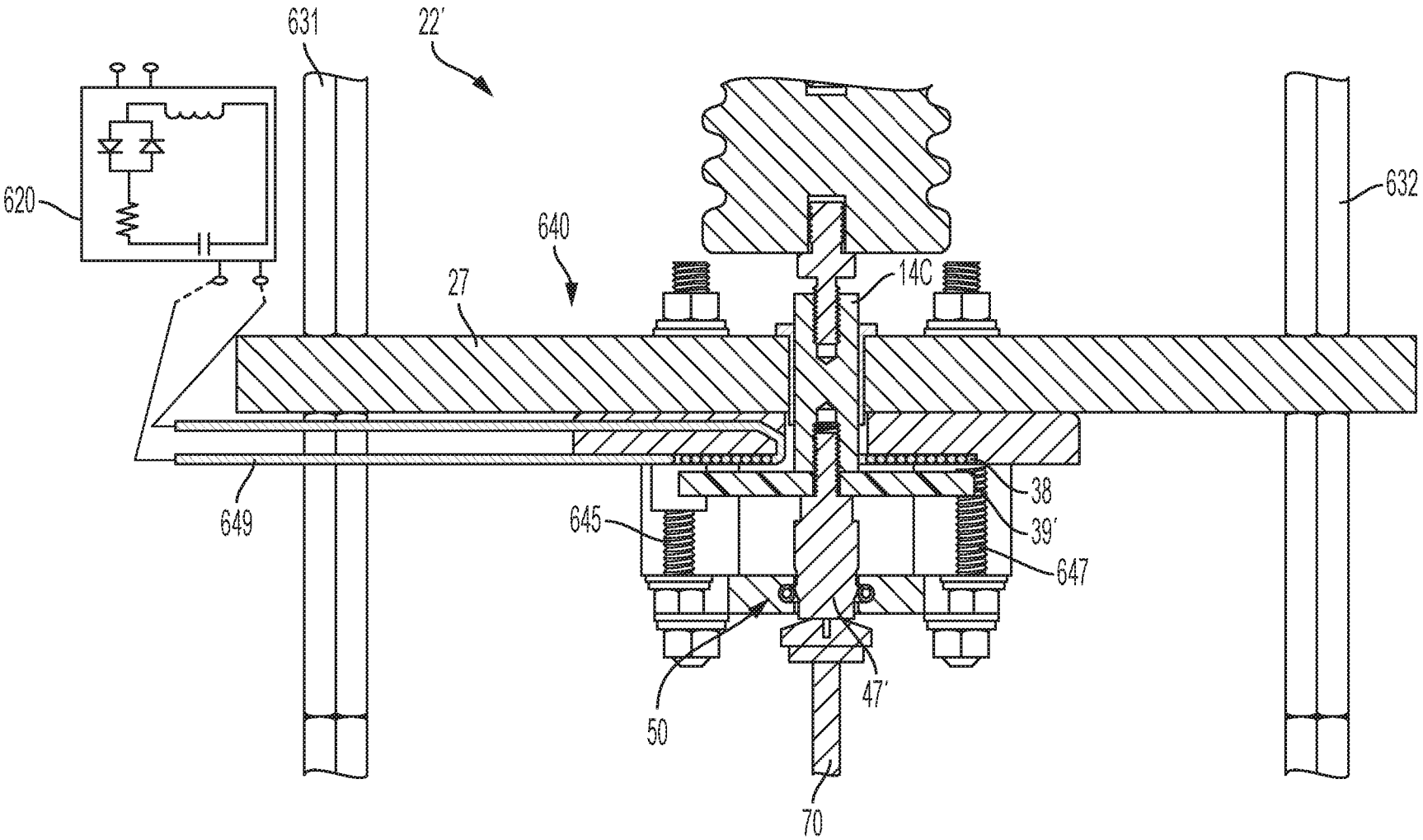
FIG. 6B illustrates a cross-sectional view of the high speed actuator in an intermediate position between a closed position and an open position and components of the decelerator.

FIG. 6B illustrates a cross-sectional view of the high speed actuator 22' in an intermediate position between a closed position and an open position and components of the decelerator. Since, FIG. 6B is essentially the same as FIG. 6A only the differences will be described. In FIG. 6B, the repulsion plate 39' is shown in a second position. The second position corresponds generally to an intermediate position where the vacuum interrupter 13 may be in an open state and an unlatched state of the latch assembly 50. In FIG. 6B, the adapter 47' is shown in a second position or intermediate position but still not in a latched position. The end of adapter 47' may impart a force to the top of the shock absorber 70 such that some amount of the imparted force may be absorbed by the shock absorber 70. The high speed actuator 22' is the same as high speed actuator 22 of FIG. 6A, except that for the purposes of illustration, the repulsion plates are shown in different positions.

In FIG. 6B, the Thompson coil 38 is energized by the driver 620. Accordingly, the repulsion plate 39' is being repelled to the second position.

Figure 6C:
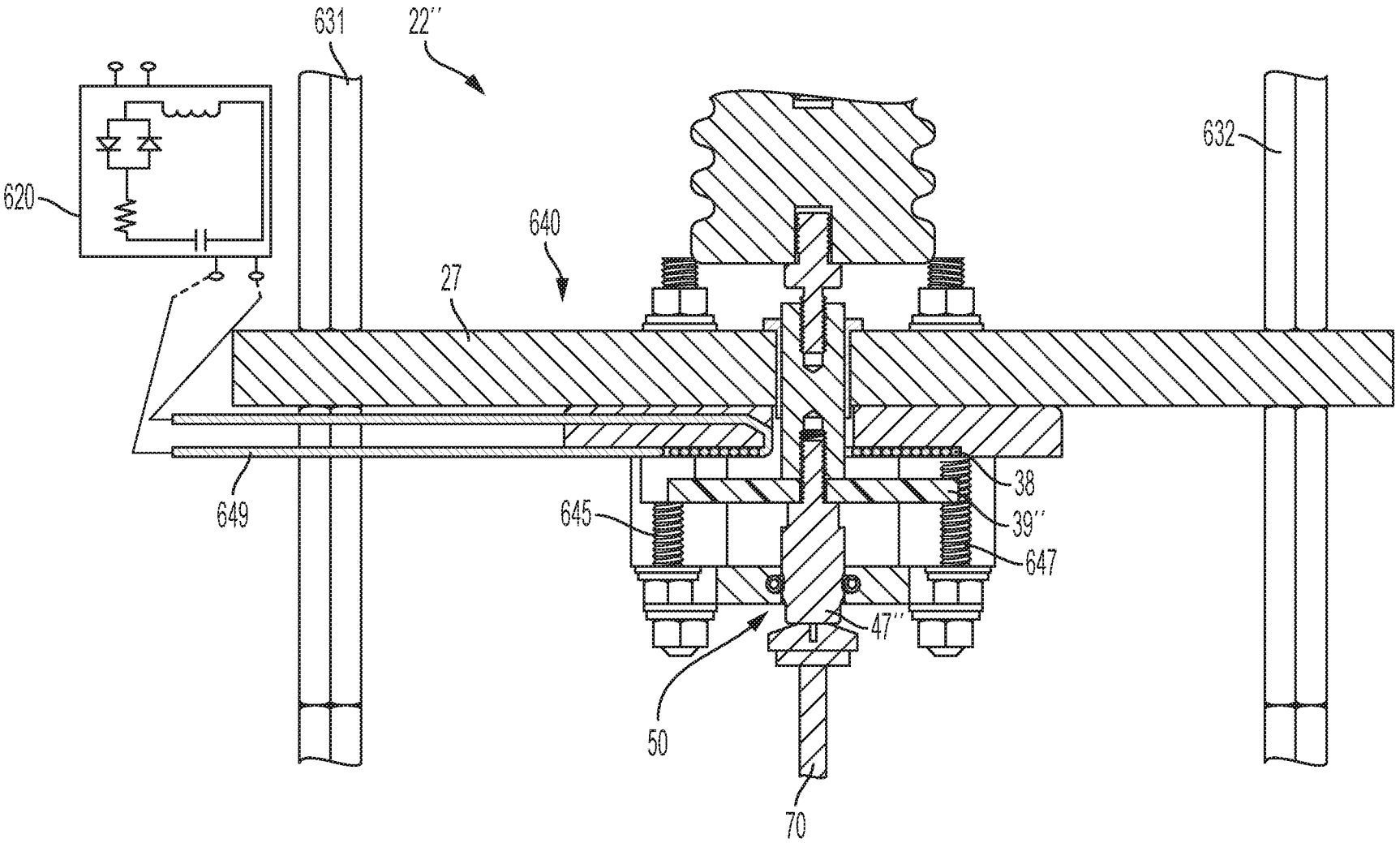
FIG. 6C illustrates a cross-sectional view of the high speed actuator in an open position and components of the decelerator.

FIG. 6C illustrates a cross-sectional view of the high speed actuator 22" in an open position and components of the decelerator. In FIG. 6C, the repulsion plate 39" is shown in a third position. The third position corresponds generally to an open position of the vacuum interrupter 13 and a latched state of the latch assembly 50. In FIG. 6C, the adapter 47" is shown in a third position corresponding to a latched position. The end of adapter 47" may impart a force to the top of the shock absorber 70 such that some amount of the force may be absorbed by the shock absorber 70.

In FIG. 6C, the Thompson coil 38 is energized by the driver 620. Accordingly, the repulsion plate 39" is being repelled to the third position.

Figure 7A:
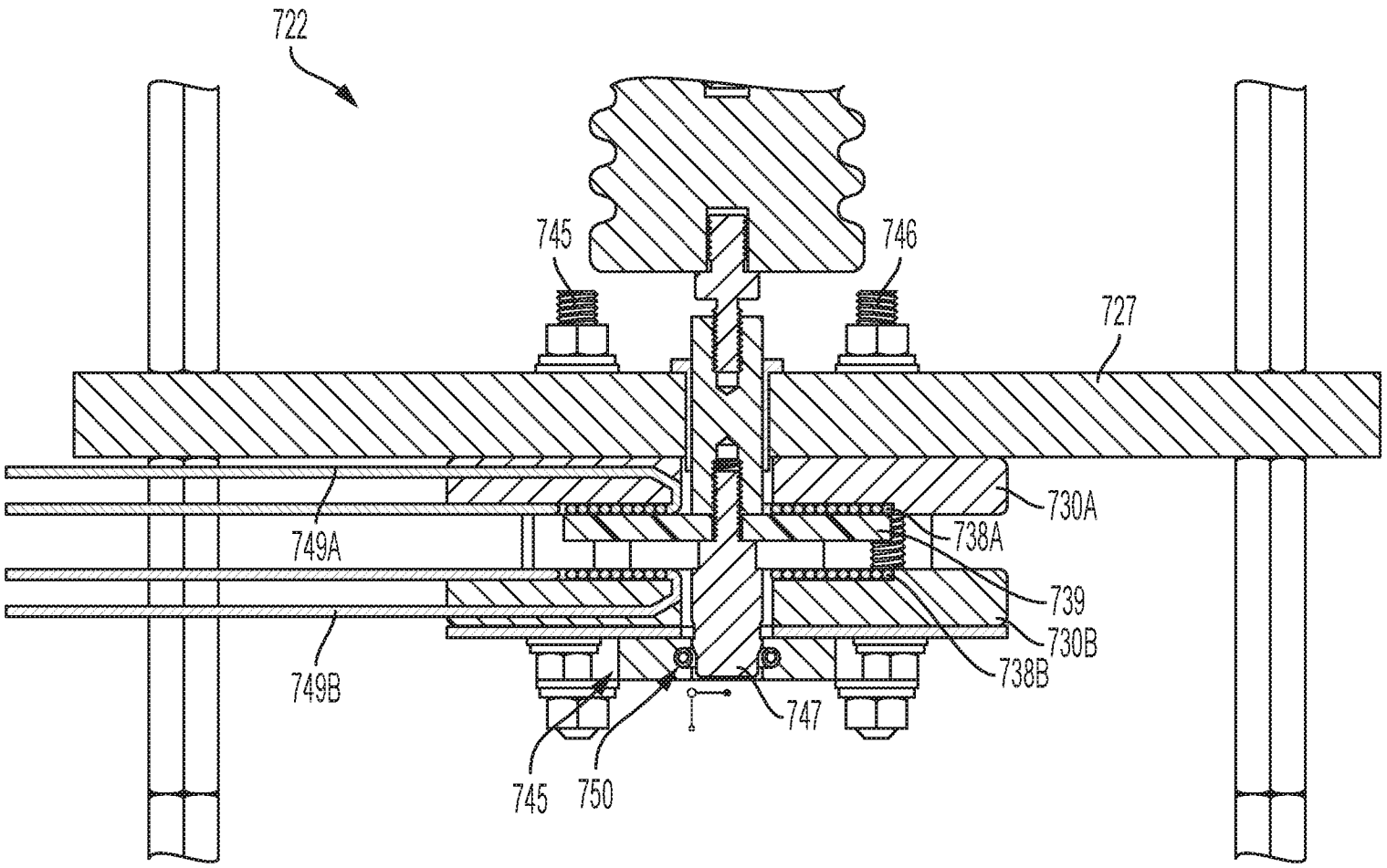
FIG. 7A illustrates a cross-sectional view of the high speed actuator in a closed position of an alternate embodiment and components of the decelerator.

FIG. 7A illustrates a cross-sectional view of the high speed actuator in a closed position of an alternate embodiment and components of the decelerator. The embodiment of FIG. 7A is similar to FIG. 6A, therefore only the differences will be described in detail. In the embodiment of FIG. 7A, two Thompson coils 738A and 738B and a repulsion plate 739 therebetween are provided. The drivers (i.e., driver 620) have been omitted from the drawing to prevent crowding in the drawing. The Thompson coil 738A is mounted to actuator mount 730A. The Thompson coil 738B is mounted to actuator mount 730B. The actuator mounts 730A and 730B are mounted in fixed spaced relation to planar support plate 727 via first and second fasteners 745 and 746 coupled to and through the planar support plate 727.

The repulsion plate 739 is shown in a first position. The first position corresponds generally to a closed state of the vacuum interrupter 13 and an unlatched state of the latch assembly 750. The latch assembly 750 operates essentially the same as latch assembly 50. Therefore, no further discussion will be provided. The adapter 747 is in a first position corresponding to an unlatched position.

Although not shown, the Thomson coil actuator also may include permanent magnets positioned proximate to each Thomson coil and a permanent magnet on the repulsion plate that will latch the repulsion plate 739 with the Thomson coil 738A to which it is adjacent, when the vacuum interrupter 13 is closed. When a Thomson coil 738A to which the repulsion plate 739 is latched is energized on conductors 749A, the repulsion force by Thomson coil 738A will push the repulsion plate 739 from its current position in FIG. 7A toward the other Thomson coil 738B to a third position, as shown in FIG. 7C, via intermediate positions shown in FIG. 7B. In FIG. 7C, the repulsion plate 739" is in a third position may be latched to the other Thomson coil 738B. The adapter 747" is also in a latched position. In FIG. 7C, the Thomson coil 738B may be energized via conductor 749B as the coil is energized by a driver (i.e., driver 620).

The Thomson coil 738B may be energized on line 749B. In one scenario, the Thomson coil 738B may be controlled such that a repulsion force therefrom is applied to the repulsion plate 739' (FIG. 7B) to counter act the repulsion force by the Thomson coil 738A for a soft landing to the Thomson coil 738B. Such a soft landing may provide a degree of deceleration force to the adapter 747' to decelerate the linkage 14. Accordingly, the decelerator 745 (i.e., decelerator 45) may further include a controlled Thomson coil 738B to control the rate at which the repulsion plate 739" reaches its final destination of essentially zero motion or velocity to latch the adapter 747".

Figure 7B:
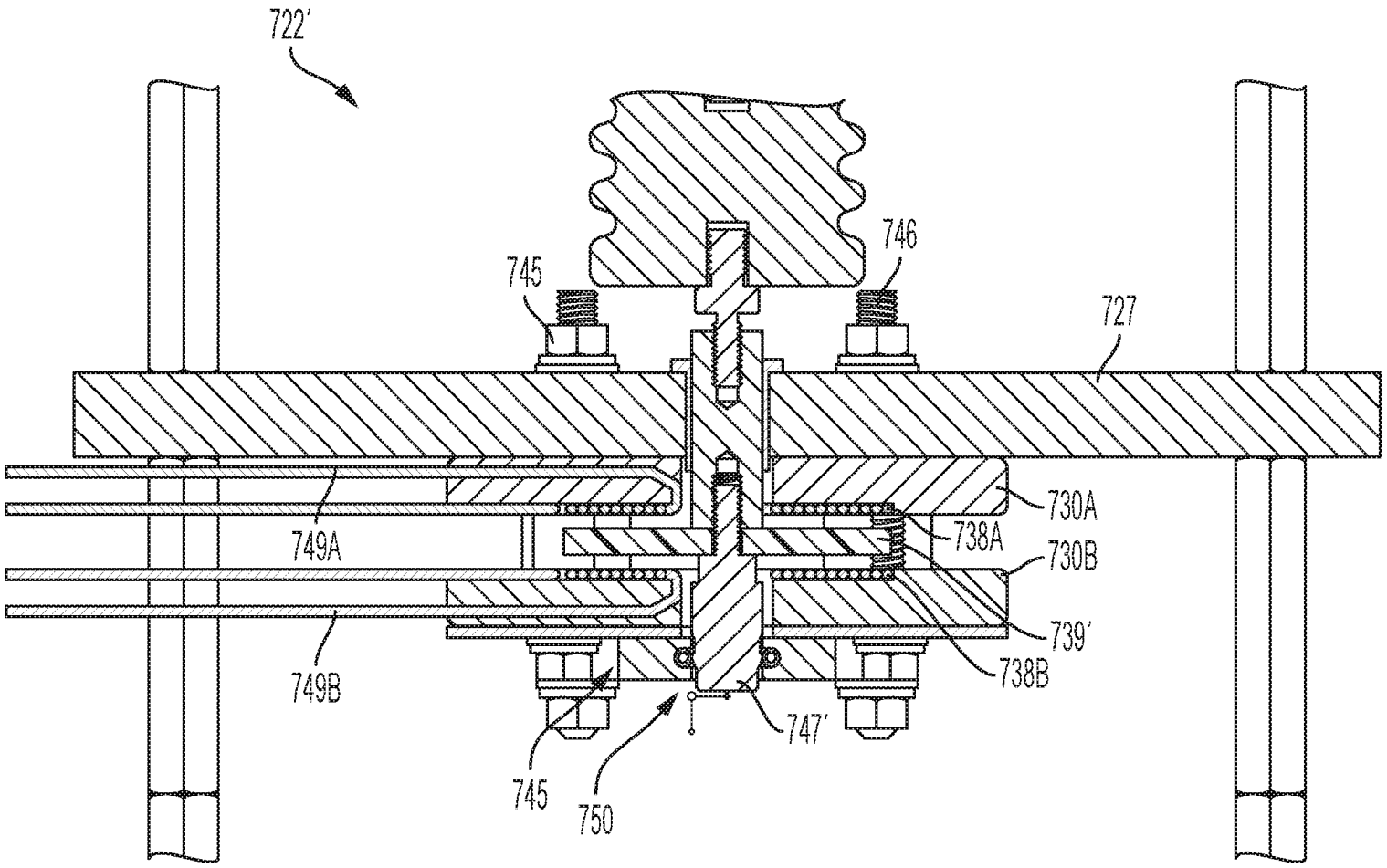
FIG. 7B illustrates a cross-sectional view of the high speed actuator in an intermediate position between a closed position and an open position of an alternate embodiment and components of the decelerator.
Figure 7C:
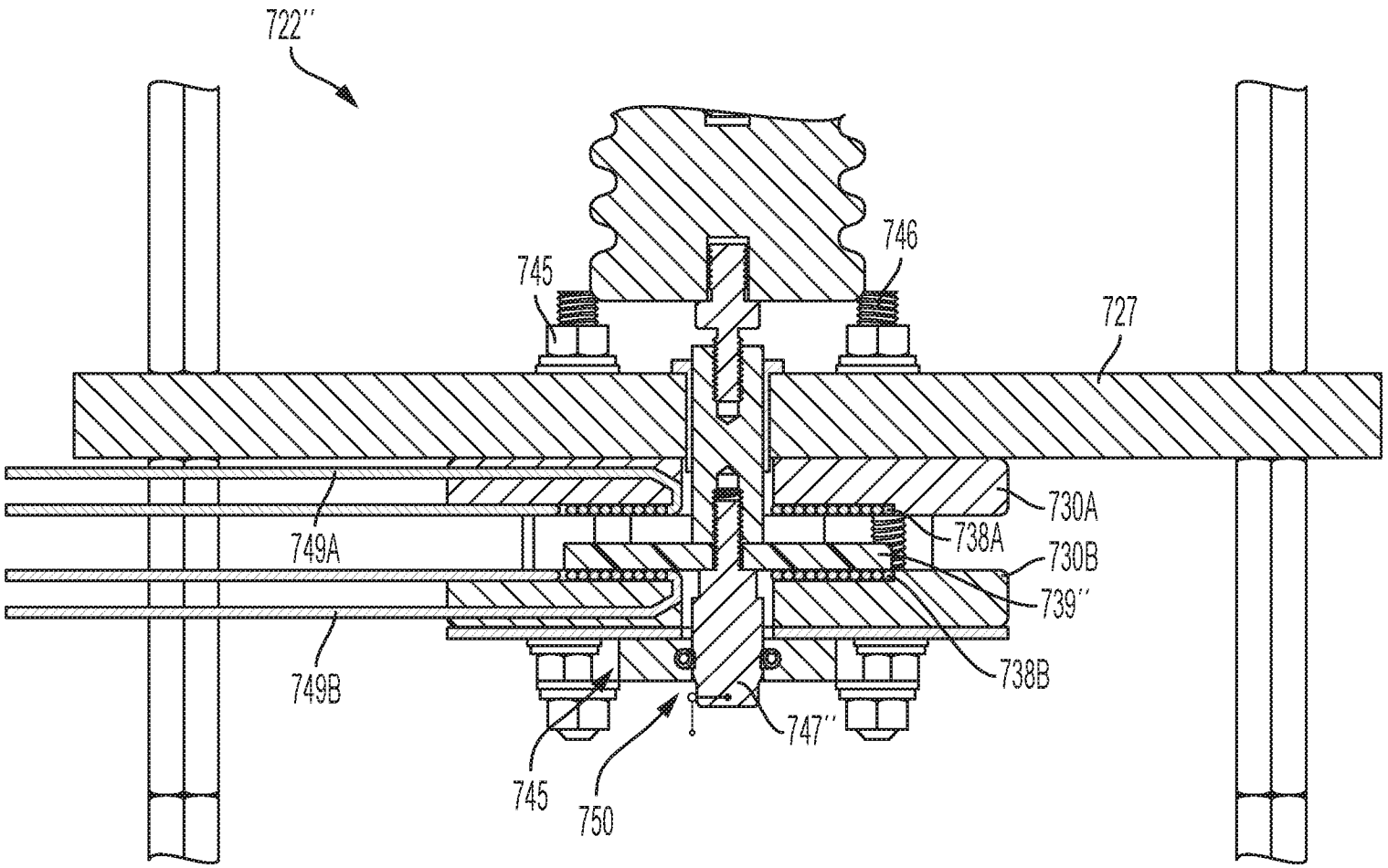
FIG. 7C illustrates a cross-sectional view of the high speed actuator in an open position of an alternate embodiment and components of the decelerator.

FIG. 7B illustrates a cross-sectional view of the high speed actuator in an intermediate position between a closed position and an open position of an alternate embodiment and components of the decelerator. In FIG. 7B, the repulsion plate 739' is in a second position or intermediate position between the Thomson coil 738A and Thomson coil 738B. The adapter 747' is also in a second position or intermediate position and in an unlatched state. In FIG. 7B, one or both the Thomson coils 738A and 738B may be energized to some degree using conductors 749A and 749B, respectively.

The illustrations shown in this document show the fixed electrode located at an upper portion of the breaker, the moving electrode at a lower portion of the breaker, and the actuators positioned below the moving electrode. However, the invention includes embodiments in which the arrangements are inverted, rotated to an angle (such as by 90 degrees to form a linear/horizontal arrangement), or otherwise. Embodiments also include arrangements in which a single set of actuators are connected to multiple pole units, as in a three-phase AC system. In such arrangements, the actuators may be connected to an operative arm, and the operative arm may be connected to the linkages of all three pole units.

The features and functions described above, as well as alternatives, may be combined into many other different systems or applications. Various alternatives, modifications, variations or improvements may be made by those skilled in the art, each of which is also intended to be encompassed by the disclosed embodiments.

The invention claimed is:

1. A circuit breaker comprising:

a vacuum interrupter having a closed position and an open position;

a linkage operatively coupled to and extending from the vacuum interrupter;

a high-speed actuator operatively connected to the linkage, wherein the high-speed actuator is operable to move the linkage by a repulsion force and cause the vacuum interrupter to move to the open position; and a decelerator with an integrated latch assembly operatively coupled to the high-speed actuator, wherein the decelerator is operative to decelerate the repulsion force of the high-speed actuator and latch the high-speed actuator with the integrated latch assembly to maintain the vacuum interrupter in the open position.

2. The circuit breaker of claim 1, wherein the high-speed actuator comprises a Thomson coil actuator.

3. The circuit breaker of claim 1, wherein the decelerator with integrated latch assembly is configured to latch at a point of zero velocity or nearly zero velocity.

4. The circuit breaker of claim 1, wherein:

the decelerator with the integrated latch assembly comprises a non-conductive adapter operatively connected to the linkage so that as the linkage is moved by the repulsion force, the non-conductive adapter being pushed, decelerated by the decelerator to a near zero velocity and automatically latched.

5. The circuit breaker of claim 4, wherein the decelerator further comprises a coil spring that is positioned to apply a frictional force to the non-conductive adapter.

6. The circuit breaker of claim 5, wherein the non-conductive adapter further comprises a cam and a latching groove, wherein the cam is positioned to compress the coil spring and decelerate motion of the non-conductive adapter as the linkage is moved by the repulsion force until the latching groove reaches and latches the coil spring.

7. The circuit breaker of claim 5, wherein the coil spring surrounds a portion of the non-conductive adapter to apply the frictional force to the non-conductive adapter.

8. The circuit breaker of claim 4, wherein the high-speed actuator further comprises a repulsion plate that is connected to the non-conductive adapter and operable to be repelled by the repulsion force.

9. The circuit breaker of claim 8, wherein the decelerator further comprises a shock absorber, configured to generate a supplemental deceleration force exerted on the non-conductive adapter and absorb at least a portion of the repulsion force in response to being pushed by the repulsion plate.

10. The circuit breaker of claim 8, wherein:

the high-speed actuator is a first high-speed actuator; and the decelerator further comprises a second high-speed actuator configured to provide a deceleration force.

11. The circuit breaker of claim 10, wherein:

the first high-speed actuator comprises a first Thomson coil actuator;

the second high-speed actuator comprises a second Thomson coil actuator; and the circuit breaker further comprises a driver electrically connected to the first high-speed actuator and the second high-speed actuator, wherein the driver is configured to energize the first Thomson coil actuator to repel the repulsion plate to open the vacuum interrupter.

12. A circuit breaker comprising:

a vacuum interrupter comprising:

a fixed electrode that leads to a fixed contact, and a moveable electrode that leads to a moveable contact;

a linkage operatively coupled to the moveable electrode and that extends from the vacuum interrupter;

a high-speed actuator operatively connected to the linkage, wherein the high-speed actuator is operable to move the linkage by a repulsion force, which pulls the moveable contact away from the fixed contact to open the vacuum interrupter; and a decelerator with an integrated latch assembly operatively coupled to the high-speed actuator and the linkage, wherein the decelerator operative to decelerate the repulsion force of the high-speed actuator and latch the linkage with the integrated latch assembly to maintain the vacuum interrupter in an open position with the moveable electrode separated from the fixed electrode.

13. The circuit breaker of claim 12, wherein the high-speed actuator comprises a Thomson coil actuator.

14. The circuit breaker of claim 12, wherein the decelerator with the integrated latch assembly comprises a non-conductive adapter operatively connected to the linkage.

15. The circuit breaker of claim 13, wherein the high-speed actuator further comprises a repulsion plate configured to be repelled by the repulsion force that is greater than atmospheric force.

16. The circuit breaker of claim 15, wherein the decelerator further comprise a shock absorber, the shock absorber configured to generate a supplemental deceleration force exerted on the non-conductive adapter and absorb at least a portion of the repulsion force exerted on the non-conductive adapter in response to being pushed by the repulsion plate.

17. The circuit breaker of claim 14, wherein the decelerator further comprises a coil spring positioned to apply a frictional force to the non-conductive adapter, and be received into a latching groove of the non-conductive adapter.

18. The circuit breaker of claim 17, wherein:

the non-conductive adapter further comprises a cam;

the cam is positioned to compress the coil spring and decelerate motion of the non-conductive adapter as the linkage moves to the open position; and the coil spring automatically decompresses into the latching groove to latch the linkage in the open position.

19. The circuit breaker of claim 12, wherein:

the high-speed actuator is a first high-speed actuator; and the decelerator further comprises a second high-speed actuator configured to provide a deceleration force.

20. The circuit breaker of claim 19, wherein:

the first high-speed actuator comprises a first Thomson coil actuator;

the second high-speed actuator comprises a second Thomson coil actuator; and the circuit breaker further comprises a driver electrically connected to the first high-speed actuator and the second high-speed actuator, wherein the driver is configured to energize the first Thomson coil actuator to repel the repulsion plate being repelled to open the vacuum interrupter.

21. The circuit breaker of claim 12, wherein the decelerator with integrated latch assembly is configured to latch at a point of zero velocity or nearly zero velocity.

* * * * *